United States Patent [19]

Andrews

[11] 4,205,545

[45] Jun. 3, 1980

[54] METHOD OF FORMING LOUVERED OPENINGS IN TUBULAR MEMBERS

[75] Inventor: Peter G. Andrews, Sylvania, Ohio

[73] Assignee: Questor Corporation, Toledo, Ohio

[21] Appl. No.: 952,495

[22] Filed: Oct. 18, 1978

[51] Int. Cl.[2] ..... B21D 28/28

[52] U.S. Cl. ..... 72/326; 29/163.5 R; 113/116 A; 113/116 UT

[58] Field of Search ..... 29/157 R, 157 C, 157.3 A, 29/163.5 R, 163 F; 113/116 A, 116 UT; 72/324, 325, 326, 335, 339, 370, 71, 393; 83/54, 180, 188, 191, 192, 693; 239/559, 568

[56] References Cited

U.S. PATENT DOCUMENTS

| | | | |
|---|---|---|---|
| 1,398,320 | 11/1921 | Dunsworth | 83/192 |
| 1,680,032 | 8/1928 | Anderson | 29/163.5 R |
| 2,367,753 | 1/1945 | Buck | 29/157 R |
| 2,583,682 | 1/1952 | Celovsky | 29/163.5 R |
| 3,259,003 | 7/1966 | Griffin | 83/54 |
| 3,540,258 | 11/1970 | Branson | 83/54 |

*Primary Examiner*—Lowell A. Larson
*Attorney, Agent, or Firm*—Harry O. Ernsberger

[57] ABSTRACT

The disclosure embraces a method of processing thin-walled tubular metal members for providing louvered openings therein, the tubes being of a character utilized as gas passage and sound attenuating means in muffler constructions for use with internal combustion engines, the method embracing shearing or lancing openings in the tube wall by employing shearing forces directed radially inwardly of a tubular member for forming the openings and deflecting inwardly the adjacent sheared or lanced portions providing inwardly deflected louvers for the openings, the method preferably including the method step of deflecting portions of the wall of the tube adjacent the openings outwardly in forming louvered openings.

10 Claims, 12 Drawing Figures

METHOD OF FORMING LOUVERED OPENINGS IN TUBULAR MEMBERSThe invention relates to a method of forming louvered openings in tubular metal members or workpieces and more especially to a method of forming louvered openings in tubular members or tubes for installation and use in sound attenuating mufflers usually of the character employed with internal combustion engines used in automotive vehicles and the like.

It has been a practice to form louvered openings in preformed tubular members by shearing or lancing openings through the application of shearing forces interiorly of a tubular member and forcing the sheared or lanced portions outwardly to form the louvers, an operation which requires severe outward radial forces in effecting a shearing of the tube wall. Such prior method has not been entirely satisfactory because of the magnitude of the forces to effect an outward shearing of the metal and outward bending of the sheared portion to form a louver, such method resulting in rapid wear of the shearing and louver forming tools necessitating frequent repair or replacement.

The invention has for an object the provision of a method of applying shearing forces externally of a tube wall, the forces acting inwardly and radially to shear or lance the metal at lengthwise spaced and circumferentially spaced selected regions along the tube whereby all of the openings desired in the tube may be fashioned in a single shearing operation, and the sheared portions deflected inwardly in the same operation forming louvers for the openings.

Another object of the invention is the utilization of a method of applying metal shearing forces externally of a tube wall, the forces acting inwardly and radially to shear or lance the metal at circumferentially spaced selected regions along the tube forming pairs of openings in adjacent relation and deflecting sheared or lanced portions inwardly wherein the inwardly deflected portions form louvers for the pairs of openings.

Another object of the invention is the provision of a method of forming louvered openings in a tubular metal member wherein external inwardly directed radial shearing or lancing forces form rows of circumferentially spaced openings at selected regions along the tubular member and deflecting inwardly a sheared or lanced portion adjacent each opening, and bending outwardly a portion of the original tube wall adjacent each opening providing an inwardly extending louver and outwardly extending louver for each opening.

Another object of the invention is the use of a method of forming louvered openings in a metal tube or workpiece wherein external inwardly radially directed shearing or lancing forces form pairs of openings arranged in circumferential rows wherein the openings of each pair are separated by first portions of the original tube configurations, the external forces deflecting sheared second portions inwardly, and internal forces directed radially outwardly against the first portions to deflect or bend the first portions outwardly, the inwardly deflected portions and the outwardly bent portions providing louver configurations for the openings.

Another object of the invention resides in a method of forming pairs of louvered openings in a metal tube or member wherein external inwardly radially directed shearing or lancing forces form pairs of openings arranged in spaced circumferential rows, the pairs of openings being in aligned lengthwise rows and each pair of openings separated by a first portion of the original tube configuration, applying external forces deflecting adjacent sheared second portions inwardly, and directing internal forces in the tube outwardly against the first portions to deflect or bend each of the first portions outwardly in a substantially V-shaped configuration, the inwardly deflected portions and the outwardly deflected portions providing louvered configurations for each pair of the openings.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

The metal tubes, tube sections or workpieces 10 in which louvered openings are to be formed according to the method of the invention are comparatively thin walled and are preferably seamed metal tubes but the tubes may be of seamless metal tubing. The tubes are preferably fashioned of steel to withstand the high temperatures existing within a sound attenuating muffler construction in which the louvered tubes may be embodied.

As an example, the tubes or tubular members may have an internal diameter of about one and one half inches or more and a wall thickness of about fifteen thousandths to sixty thousandths of an inch, the lengths of the tubes being dependent upon the type and size of sound attenuating muffler construction in which the louvered tubes may be embodied. The louvered openings to be formed in the tubes are arranged in circumferentially spaced lengthwise rows and extend throughout a substantial portion of the tubes.

The louvered openings are preferably formed in pairs wherein selected regions of the tubular member are sheared each side of a portion of the tube wall herein referred to as first portions of the tubular member and the sheared portions deflected inwardly and herein referred to as second portions.

Figure 1:
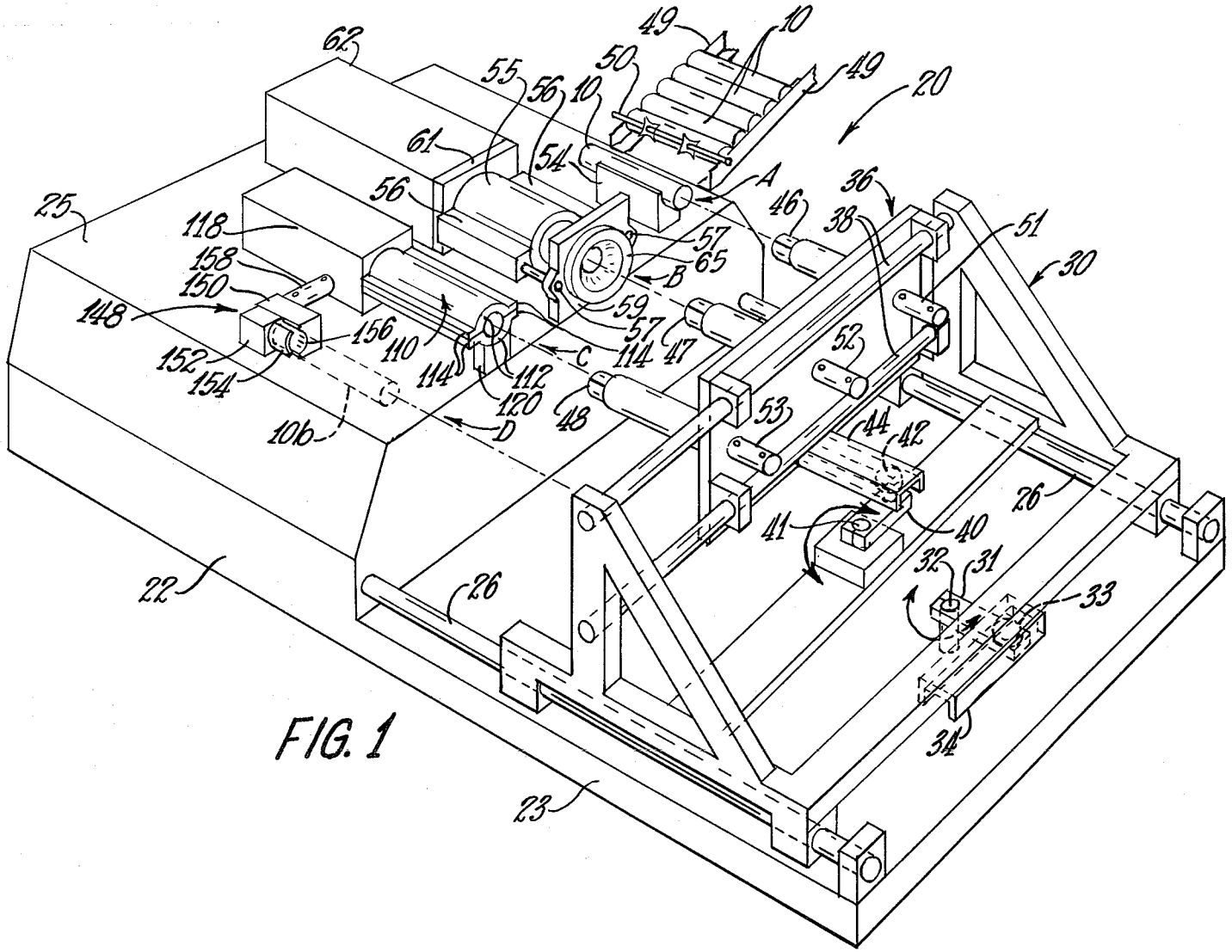
FIG. 1 is a semischematic isometric view of a form of apparatus for performing steps in the method of the invention for forming louvered openings in metal tubes.

Referring to FIG. 1, the metal tubes 10 are delivered to a tube feeding or loading Station A preparatory to being moved or transferred to processing stations.

Figure 6:
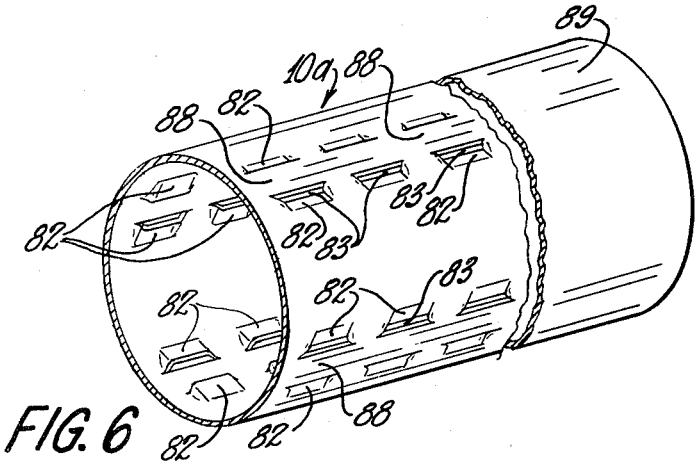
FIG. 6 is a semischematic isometric view of a portion of a metal tube illustrating the configuration of lanced portions performed by the lancing operation.

Station B, indicated in FIG. 1, is a first processing station at which wall portions of the tube are sheared or lanced at selected regions to form openings which are circumferentially and longitudinally spaced in the tube wall. FIG. 6 illustrates a section of a tube 10*a* showing the lanced openings in the tube wall performed by lancing operations at Station B.

At Station C, indicated in FIG. 1, further processing operations are performed on the lanced tube shown in FIG. 6 to form a louvered tube or tube section 10*b* illustrated in FIG. 7 and hereinafter described.

Figure 8:
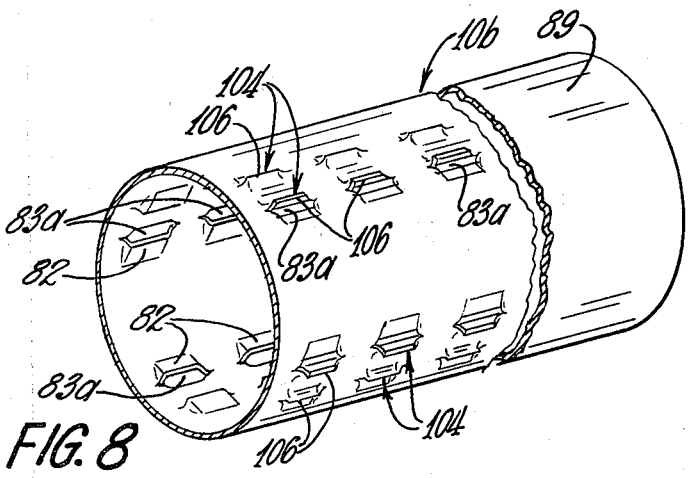
FIG. 8 is a semischematic isometric view of a portion of a metal tube illustrating the configuration of the formed louvered portions and openings at the completion of the forming operation.

At Station D, indicated in FIG. 1, the louvered tube 10*b* shown in FIG. 8 is removed after completion of the processing operations.

Figure 2:
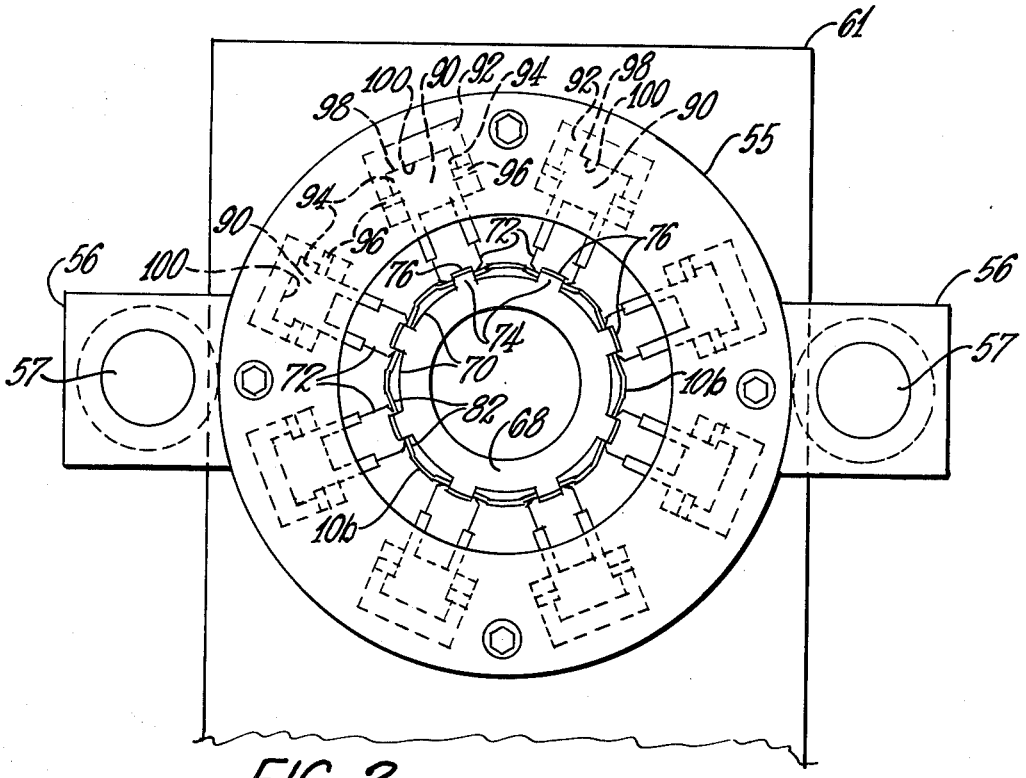
FIG. 2 is an end view of an instrumentality or facility for performing lancing or shearing operations in the wall of a metal tube.
Figure 3:
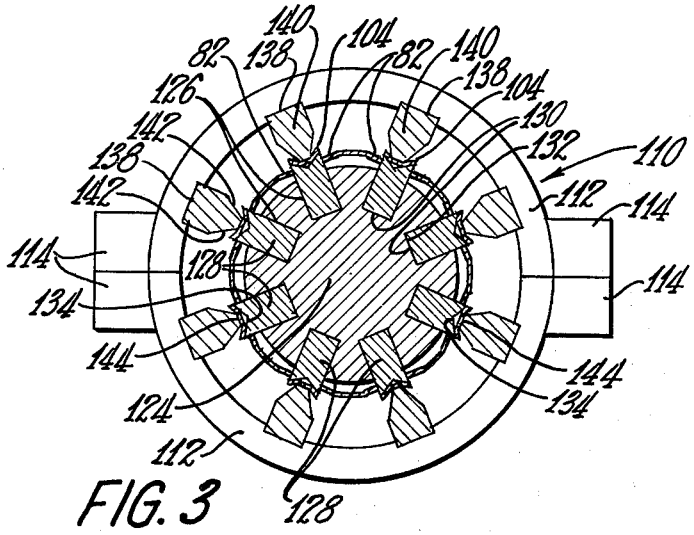
FIG. 3 is a sectional view of a forming instrumentality in configurating portions of a tube wall in forming louvered openings in the wall.
Figure 4:
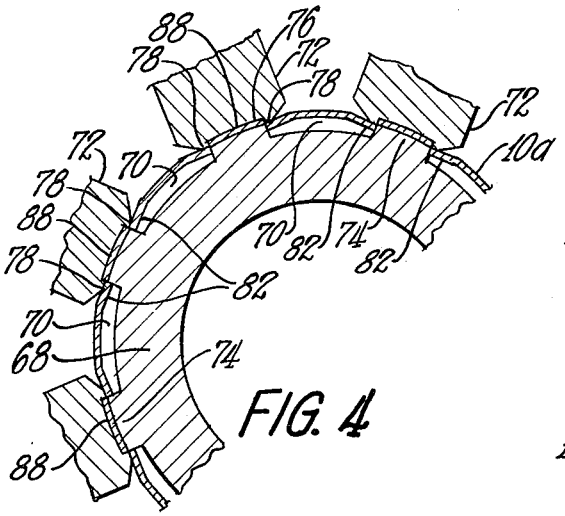
FIG. 4 is an enlarged fragmentary section illustrating a lancing operation on a tube wall.
Figure 5:
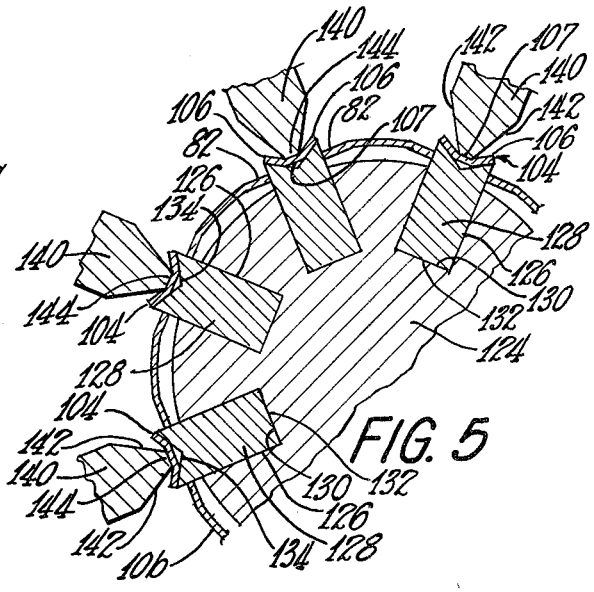
FIG. 5 is an enlarged fragmentary section illustrating the method of configurating portions of a tube wall in forming louvered openings.

The shearing or lancing method operations in the tube wall are performed at Station B by an arrangement illustrated in FIGS. 2 and 4 and the operations of forming bent louvers of the tube wall at the openings are performed at Station C by an arrangement illustrated in FIGS. 3 and 5.

A form of apparatus 20 for performing the method steps of the invention is schematically illustrated in FIG. 1 and includes a base or frame structure 22 having a forwardly extending portion 23 and a platform portion 25. Slidably mounted upon rods or supports 26 adjacent the portion 23 of frame 22 is a carriage 30 movable lengthwise of the frame. Mounted on the carriage 30 is a transversely movable carriage 36.

The carriage 30 is reciprocated by conventional means which includes a rotatable member 31 mounted on a rotatable shaft 32, the member 31 having a pin 33 extending into a channel 34 fixedly mounted on the carriage 30. Rotation of the shaft 32 causes the pin 33 to move the channel thus reciprocating the carriage 30 along the rods 26. The carriage 36 is mounted upon rods 38 supported on the carriage 30 and is slidable transversely of the carriage 30 along the rods 38. The carriage 36 is reciprocated transversely by conventional means which includes a member 40 mounted upon a rotatable shaft 41, the member 40 having a pin 42 which extends into a channel member 44 which is fixedly secured to the carriage 36.

The transversely movable carriage or carrier 36 is equipped with three tubular member engaging chucks or tube transfer means 46, 47 and 48. The transfer means or chucks are of the conventional collapsible jaw type and are moved to tube-engaging and disengaging positions under the influence of fluid-actuated servomotor means. The fluid-actuated servomotor means 51, 52 and 53 respectively control and actuate the work transfer means or chucks 46, 47 and 48 to grip and to release tubes during processing operations.

A supply of unprocessed metal tubes, tube sections or tubular members 10 is provided at the loading Station A, the tubes being supported by ramps 49. The tubes are released from the supply by conventional gating means 50 programmed to release a tube at the proper time onto a tube support member or loading block 54 in a position to be engaged by the collapsible chuck or tube gripping and transferring means 46.

The processing operations performed at Station B will now be described. The arrangement of the lancing facility or instrumentality at Station B comprises a generally cylindrically-shaped hollow member or head 55 having laterally extending members 56 bored to receive supporting rods 57, the cylindrically-shaped head 55 being longitudinally slidable upon the rods 57.

Secured to the platform portion 25 of the frame structure and forwardly of the cylindrically-shaped member 55 is a frame plate 59, the plate 59 having ear portions receiving and supporting one end of each of the rods 57. Disposed rearwardly of the cylindrical member 55 is a frame plate 61 mounted on the frame platform 25, the plate 61 having openings (not shown) receiving the ends of the rods 57 providing support for the rods.

The head 55 contains lancing or shearing instrumentalities, cutters or tools which are actuated by longitudinal movement of the head 55. Means (not shown) is contained within an enclosure 62 for reciprocating the cylindrical member or head 55 for purposes hereinafter explained. Secured to the plate 59 is a circular member 65 having means (not shown) supporting radially movable lancing tools or shearing instrumentalities.

Disposed interiorly of the hollow member 55 are radially arranged lancing or shearing tools or instrumentalities shown in FIGS. 2 and 4. Extending lengthwise and centrally of the member 55 is a stationary arbor or mandrel 68 which may be supported by plate 61. The arbor 68 is of a diameter to slidably receive and support a tube 10 on which processing operations are to be performed.

The arbor 68 is provided with circumferentially spaced lengthwise extending recesses 70 to accommodate lancing of openings in the tube wall and to accommodate the lanced portions of the tube as the portions are moved inwardly radially by the lancing tools or cutters 72 as illustrated in FIGS. 2 and 4. The arbor 68 is fashioned with radially arranged outwardly extending portions 74 disposed between adjacent pairs of recesses 70 for supporting the wall or first portions 88 between adjacent recesses 70.

Each of the lancing or shearing tools 72, as shown in FIGS. 2 and 4, is provided with a recess 76 defined by two tapered projections 78. The edges of the projections 78 defining the recesses 76 are very sharp and form the lancing or severing elements for lancing or cutting the tube wall, the tapered projections 78 bending or deflecting the portions of the tube wall engaged thereby, the inwardly deflected second portions 82 being shown particularly in FIGS. 2 and 4, these inwardly bent portions forming openings 83 in the tube wall and portions of the louver configuration shown in FIGS. 6 and 7.

The recesses 70 accommodate the inward radial movement of the lancing tools 72 and the inwardly bent portions 82 of the tube wall. The projections 74 support portions 88 of the tube and the portions 88 are not affected by the severing edges of the lancing tools 72 which are moved radially inwardly to perform a severing or lancing operation as illustrated in FIGS. 2 and 4.

As hereinafter explained in the sequence of operations, an unprocessed tube 10 is moved by the chuck or tube transfer means 46 in a left-hand direction, as viewed in FIG. 1, telescoping the tube 10 over the arbor 68 shown in FIGS. 2 and 4.

The lancing tools 72 extend lengthwise of the head 55 and are mounted in tool holders, bars or members 90 contained within the head 55 and extending lengthwise thereof. The interior of head 55 is provided with longitudinally arranged members 92 of U-shaped cross section receiving the bars 90. Each of the tool carrying bars 90 is provided with projections 94 forming a T-like head construction.

The T-shaped head portions of the bars are held within the U-shaped track portions 92 by means of bars 96 secured to the track bars 92 by screws (not shown). The inner surface 98 of each of the track members 92 is tapered forwardly and outwardly in a right-hand direction, as viewed in FIG. 1, and the cooperating surface 100 of each tool carrier 90 is tapered inwardly and rearwardly whereby longitudinal movement of the head or member 55 in a right-hand direction, as viewed in FIG. 1, moves each of the lancing tools 72 inwardly to effect a lancing operation in a tube 10 under the influence of the cooperating tapered surfaces 98 and 100.

When the right-hand end of the head 55 engages the plate 59, as viewed in FIG. 1, the lancing tools have completed a lancing operation and are in their radially innermost position as shown in FIG. 2. At the completion of the lancing operations at Station B, the head 55 is moved rearwardly in a left-hand direction, as viewed in FIG. 1, until the head 55 engages the plate 61.

Figure 7:
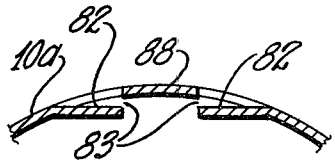
FIG. 7 is an enlarged fragmentary section through a tube wall illustrating the configuration defining a lanced opening at the completion of a lancing operation.

As the head 55 moves in a rearward direction, the T-shaped configuration 94 on each of the tool holders or bars 90 effects a radially outward retraction of each of the tool holders 90 and the lancing tools carried thereby completing the lancing operations shown on the tube **10*a* in FIGS. 6 and 7. Each of the processed tubes is provided with an end portion 89** of a tube which is not lanced with openings and provides a smooth surface portion to be engaged and gripped by a chuck during tube transferring operations.

The tube **10*a* while still contained within the head 55 is engaged by the chuck 47 in a manner hereinafter described, and through the movement of the carriages 30 and 36, the tube 10*a* is transferred to Station C and is delivered thereby into a processing facility at Station C which contains means or tools for bending the intermediate tube wall portions 88 outwardly to generally V-shaped configurations as illustrated at 104 in FIGS. 3, 5, 8 and 9. The portions 104 are of V-shaped configurations, each having angular portions 106 joined by a narrow bight portion 107**.

Figure 9:
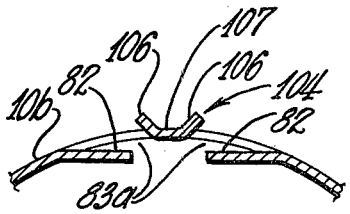
FIG. 9 is an enlarged fragmentary section similar to FIG. 7 illustrating the formed louvers and openings in a processed tube.

As shown in FIG. 9 the outwardly extending portions or louvers 106 and the inwardly extending lanced portions or louvers 82 provide openings **83*a* which are of substantially greater area than the openings 83 formed in the tube wall by the lancing operation. The openings 83*a* in the tube 10*b*** provide ample passage areas through the tube wall to accommodate flow of gases of combustion where the tube is embodied in a sound attenuating muffler construction.

At Station C there is provided a facility or instrumentality for bending the portions 88 of a lanced tube outwardly to a V-shaped configuration to form louvers 106 providing the louvered portion 104 in a tube **10*b*, the processing of the formation of the louvered openings 83*a* being completed at Station C. The means or instrumentalities for bending the portions 88 of a tube 10*a* outwardly to a V-shaped configuration are enclosed in a housing or casing 110 shown in FIGS. 1 and 3**.

The housing or casing 110 is fashioned of two semicylindrical mating portions 112, each of the portions 112 having diametrically disposed laterally extending pairs of projections 114 secured together by suitable means (not shown). As illustrated in FIG. 1, the enclosure 110 is supported at its rearward end by a housing 118, the forward end being supported by a block or member 120 mounted upon the platform portion 25 of the frame structure.

Disposed within and extending lengthwise of the housing 110 is an arbor, mandrel or support 124 which is longitudinally reciprocable within the housing 110. The mandrel or arbor 124 is reciprocated by fluid pressure actuated means or servomotor (not shown) of conventional construction. The arbor or mandrel 124 is fashioned with a plurality of radially arranged recesses 126 in which are disposed lengthwise arranged bending tools or bars 128 which are radially slidable in the recesses 126 in the arbor 124.

Each of the bottom surfaces 130 of the recesses 126 is tapered forwardly and inwardly and each of the mating bottom surfaces 132 of the tools or bars 128 is reciprocally tapered rearwardly and inwardly. Through this arrangement a forward longitudinal movement of the arbor 124, as viewed in FIG. 1, forces the metal bending tools or bars 128 outwardly. The outermost surface of each of the bars or tools 128 is fashioned with a V-shaped configuration 134 of a dimension to engage a portion 88 of a lanced tube **10*b***.

Mounted in circumferentially-spaced radially-arranged recesses 138 are stationary bars, members or anvils 140 shown in FIGS. 3 and 5. The inner portions of the bars or anvils 140 are formed with convergently-arranged angular surfaces 142. A flat bight portion 144 which is comparatively narrow is defined by the convergently-arranged angular surfaces 142 as particularly shown in FIGS. 3 and 5. The bars or anvils 140 are fixedly secured to the stationary housing construction 110.

When a lanced tube **10*a* is telescoped over the mandrel or arbor 124, the metal deforming or bending tools or bars 128 are in inwardly retracted position. During lengthwise movement of the arbor or mandrel 124 relative to the housing 110 with a tube 10*a* on the mandrel or arbor, the metal bending tools 128 are moved radially outwardly. During this movement the V-shaped configurations 134 on the outer surfaces of the tools or bars 128 force the metal of the portions 88 of the tube outwardly in divergent angular directions forming the louvers or louver portions 106 which are joined by narrow metal bight portions 107 as particularly shown in FIGS. 5 and 9**.

After the completion of the processing of the tube **10*b*, the tube is transferred to a tube removal and disposing station indicated at D in FIG. 1. The tube receiving facility 148 at Station D includes a support 150 mounted on the frame structure 25. Reciprocably carried by the support is a member 152 equipped with a semicylindrical tube-gripping portion 154**.

The support member 150 is fashioned with a semicylindrical recess 156 which mates with the portion 154 whereby the member 152 may be moved to engage the grip member 154 with a processed tube **10*b* shown in broken lines and which may be released to dispose of the tube. A fluid pressure type servomotor 158 of conventional construction is utilized to reciprocate the member 152 to hold the tube 10***b* during release of the chuck member carrying the tube and to thereafter release the tube after the chuck 48 has been disengaged and withdrawn from the tube.

With reference particularly to FIGS. 1 and 10 through 12, the sequence of operations in processing a tube or tube section 10 to form a tube 10*b* having louvered openings is as follows: A plurality of unprocessed metal tubes or tube sections 10 are provided as a supply, the tubes being supported upon ramps 49 shown in FIG. 1. The gating means 50 is operated by conventional means (not shown) at the proper time to permit the foremost tube of the supply to move by gravity to the position supported by the block or member 54 shown in FIG. 1.

Figure 10:
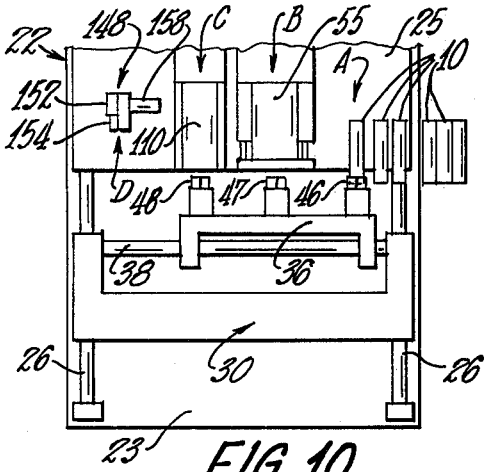
FIG. 10 is a schematic plan view of the apparatus illustrating an operational step in forming louvered openings in metal tubes.

The chucks 46, 47 and 48 in collapsed or open position are moved forwardly by the carriage 30, as viewed in FIGS. 1 and 10, to the position shown in FIG. 10, the transversely movable carriage 36 being in its extreme right-hand position. The forward movement of carriage 30 engages the open chuck 46 with the tube 10 supported by the block 54 at the feeding or loading Station A. The open chuck 46 telescopes over the end of the tube 10 at Station A and the chuck actuated by the servomotor 51 to close the chuck 46 gripping the tube 10 at Station A.

Figure 11:
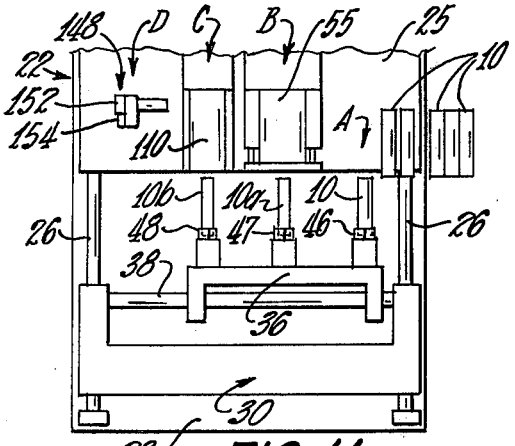
FIG. 11 is a semischematic view similar to FIG. 10 illustrating an operational step in the method of forming louvered openings in metal tubes.

The carriage 30 is then moved away from the platform portion 25 of the apparatus to the position shown in FIGS. 1 and 11 with a tube 10 supported by the chuck 46. The carriage 36 is then moved in a left-hand direction to the position shown in FIG. 12 at which the tube is axially aligned with the lancing instrumentalities contained within the head 55 at Station B.

Figure 12:
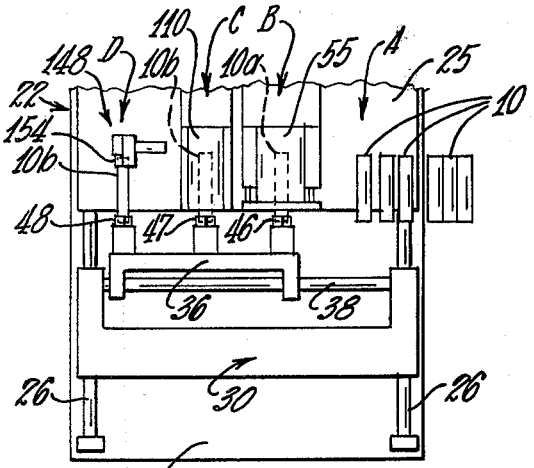
FIG. 12 is a semischematic view illustrating another operational step in the method of forming louvered openings in metal tubes.

The carriage 30 is then advanced to the position shown in FIG. 12 wherein the tube carried by the chuck 46 is advanced into the lancing facility at Station B. The lancing instrumentalities or tools 72 shown in FIGS. 2 and 4 are actuated by lengthwise movement of the head 55 to lance the tube as shown in FIGS. 2 and 4 by inward radial movement of the lancing tools.

After the completion of a lancing operation, the chuck 46 is opened releasing the tube 10*a* and the carriage 30 retracted to a position shown in FIG. 11, the lanced tube 10*a*, indicated in broken lines in FIG. 12, remaining within the lancing facility at Station B. The carriage 36 in its retracted position, shown in FIG. 11, is then moved in a right-hand direction which aligns the chuck 47 with the lancing facility in the head 55 and aligns the chuck 46 with an unprocessed tube 10 supported by the block 54 at Station A.

The carriage 36 in its right-hand position is then moved forwardly by forward movement of the carriage 30 with the chucks 46 and 47 in open position whereby the chuck 46 moves into a position to grip an unprocessed tube 10 and the chuck 47 moved inwardly whereby the chuck 47 engages the end region of the tube 10*a* in the lancing facility at Station B. The servomotors 51 and 52 are activated to close the chucks 46 and 47, the chuck 46 gripping an unprocessed tube 10 and the chuck 47 gripping the lanced tube 10*a*.

The carriage 30 is then retracted to the position shown in FIG. 11, the chuck 46 carrying an unprocessed tube from the block 54 and the chuck 47 carrying the tube 10*a* away from the lancing facility. The carriage 36 is then moved in a left-hand direction which aligns the unprocessed tube 10 with the lancing facility at Station B and aligns the lanced tube 10*a* with the louver bending facility at Station C.

The carriage 30 is then advanced to move the unprocessed tube 10 into the lancing facility of Station B and the lanced tube 10*a* into the louver bending facility at Station C. Concomitantly the chucks 46, 47 and 48 are released and a lancing operation is performed at Station B on the unprocessed tube 10 and a louver forming operation performed at Station C.

Chucks 46, 47 and 48 are then closed by the servomotors 51, 52 and 53 whereby chuck 46 engages an unprocessed tube 10 supported by the block 54, the lanced tube 10*a* at Station B is gripped by the chuck 47 and the tube 10*b* engaged by the chuck 48. The carriage 30 is retracted to the position shown in FIG. 11 with the three tubes carried respectively by the chucks 46, 47 and 48.

The carriage 36 is then moved transversely in a left-hand direction which action aligns the unprocessed tube 10 with Station B, aligns the lanced tube 10*a* with Station C and aligns the completed tube 10*b* with the tube removing device at Station D. With the carriage 36 in the left-hand position, the carriage 36 is moved forwardly by forward movement of the carriage 30 to the position shown in FIG. 12 which action moves the unprocessed tube 10 into the lancing facility at Station B, moves the lanced tube 10*a* into the louver bending facility at Station C and moves the processed tube 10*b* into the tube removing facility at Station D.

The servomotor 158 at Station D is activated moving the clamp 154 into clamping engagement with the tube 10*b*. The chucks 46, 47 and 48 are then released and the carriage 30 moved to its retracted position which moves the carriage 36 to its retracted position. The servomotor for the tube clamping means 154 is activated to release the tube for disposition into a container or other receiver (not shown).

From the foregoing description it will be apparent that the method steps occur in sequence concomitantly and that three tubes at each cycle of operations are transferred by the three chucks 46, 47 and 48 to effect positioning of an unprocessed tube 10 in the chuck 46 and the tubes transferred by the chucks 47 and 48 subjected respectively to the lancing operation at Station B and the louver expanding operation at Station C. These operations occur simultaneously with the carriage 36 in its right-hand position.

When the carriage is moved to the left-hand position, as shown in FIG. 12, the chucks are transferred so that an unprocessed tube in chuck 46 is lanced at Station B, the lanced tube has the louvers bent outwardly at Station D and the tube 10*b* engaged by the clamp 154 for disposing of the processed tube 10*b*. Through this method three tubes are transferred at each transverse movement of the carriage 36 thus providing a method whereby the tubes are lanced and louvered at a high rate of production.

It is to be understood that the lancing operation of forming openings in a tube of the character shown in FIGS. 6 and 7 may include deflecting or bending the portions 82 farther inwardly a distance sufficient to provide openings 83 of larger open area whereby the tube construction shown in FIG. 6 made according to the method of the invention may be used as a sound attenuating and gas passage means in a muffler construction.

It is to be further understood that the tube may be sheared to form a single opening 83 in each selected area in processing a tube wall, deflecting the adjacent portion 82, shown in FIGS. 7 and 9, inwardly and bending an adjacent region or portion of the tube wall outwardly to form a single louvered opening. Such single louvered openings may be arranged in circumferential rows and the rows spaced lengthwise of a tube.

It is apparent that, within the scope of the invention, modifications and different arrangements may be made other than as herein disclosed, and the present disclosure is illustrative merely, the invention comprehending all variations thereof.

I claim:

1. The method of forming louvered openings in the wall of a tubular thin-walled metal member of circular cross section wherein the louvered openings extend lengthwise of the tubular member and are arranged in pairs in rows disposed lengthwise of the tubular member and spaced circumferentially around the tubular member including internally supporting the tubular member wherein the internal support has recesses adjacent regions of the pairs of openings of the rows, shearing the wall at selected spaced regions simultaneously between first and second portions of the tubular member by forces directed exteriorly and inwardly of the tubular member to form pairs of sheared second portions, and deflecting the sheared second portions inwardly of the tubular member into the recesses forming the louvered openings in the tubular wall defined by the deflected second portions and adjacent first portions of the wall.

2. The method of forming louvered openings in the wall of a tubular metal member of circular cross section wherein the louvered openings extend lengthwise of the tubular member and are arranged in pairs in rows disposed lengthwise of the tubular member and spaced circumferentially around the tubular member including mounting the tubular member on a support having recesses therein adjacent regions of the pairs of openings in the tubular member, shearing the wall between first and second portions of the tubular member adjacent the recesses by forces directed exteriorly and inwardly of the tubular member, and deflecting the sheared second portions inwardly of the tubular member into the recesses, the second portions forming with said first portions the pairs of openings in the wall adjacent the sheared second portions.

3. The method of forming a plurality of louvered openings in the wall of a tubular metal member of circular cross section wherein the louvered openings defined by first and second portions of the tubular member extend lengthwise of the tubular member and are arranged in pairs in rows at selected spaced regions lengthwise of the tubular member and the pairs spaced circumferentially around the tubular member including mounting the tubular member on a first support having recesses adjacent the regions of the pairs of openings, shearing the wall at the regions between first and second portions of the tubular member by forces directed exteriorly and inwardly of the tubular member, deflecting the sheared second portions inwardly of the tubular member into the recesses of the first support, transferring the sheared tubular member onto a second support, and deflecting the first portions adjacent the second portions outwardly of the tubular member by outwardly directed forces forming the first portions into V-shaped configuration, the outwardly deflected first portions defining with said second portions louvered openings in the wall.

4. The method of forming a plurality of louvered openings in the wall of a tubular metal member of circular cross section wherein the louvered openings extend lengthwise of the tubular member and are arranged in pairs in rows disposed lengthwise of the tubular member and spaced circumferentially around the tubular member including supporting the tubular member upon a first arbor having recesses adjacent the regions of the pairs of openings, shearing the wall at the regions adjacent the recesses between selected first and second portions of the tubular member by forces directed exteriorly and inwardly of the tubular member, deflecting the sheared second portions inwardly of the first portions into the recesses, removing the sheared tubular member from the first arbor, mounting the sheared tubular member on a second supporting arbor, engaging the internal surfaces of the first portions from within the tubular wall by outwardly directed forces, and bending the engaged first portions outwardly by the outwardly directed forces.

5. The method according to claim 4 wherein the inwardly directed shearing forces are applied simultaneously to the selected regions of the wall of the tubular member.

6. The method according to claim 4 wherein the outwardly directed bending forces are applied simultaneously to all of the said first portions of the wall of the tubular member.

7. The method of forming a plurality of louvered openings in the wall of a tubular metal member of circular cross section wherein the louvered openings extending lengthwise of the tubular member are arranged in pairs in rows disposed lengthwise of the tubular member and spaced circumferentially around the tubular member including mounting the tubular member upon a first support having recesses adjacent the regions of the pairs of openings of the rows, shearing the wall at the regions of the recesses between first and second portions of the tubular member adjacent each of the recesses by forces directed exteriorly and inwardly of the tubular member, internally supporting the first portions of the tubular member by the first support during shearing of the wall, deflecting the sheared second portions adjacent the sides of each first portion inwardly of the tubular member into the recesses, mounting the sheared tubular member upon a second support, engaging the internal surface of each of the first portions from within the tubular wall intermediate each pair of second portions by a bar, exerting outwardly directed forces on the bars, and bending the engaged first portions by the bars into substantially V-shaped configurations by the outwardly directed forces.

8. The method of forming a plurality of louvered openings in the wall of a tubular member wherein the louvered openings are arranged in pairs in rows disposed lengthwise of the tubular member and spaced circumferentially of the tubular member including mounting the tubular member upon a first support having recesses adjacent the regions of each pair of openings of the rows, shearing the wall at the regions of the recesses between first and second portions of the tubular member adjacent each of the recesses by forces directed exteriorly and inwardly of the tubular member while internally supporting the first portions at the regions between adjacent recesses, deflecting the sheared second portions inwardly of the tubular member into the recesses, mounting the sheared tubular member on a second support, engaging the exterior central region of each of the first portions with an anvil, engaging the internal surfaces of the first portions of the tubular wall intermediate each pair of second portions with anvils by outwardly directed forces, and bending each of the engaged first portions at each side of an anvil to an angular position by the outwardly directed forces.

9. The method of forming a plurality of louvered openings in the wall of a tubular metal member of circular cross section wherein the louvered openings extending lengthwise of the tubular member are arranged in pairs in rows disposed lengthwise of the tubular member and spaced circumferentially around the tubular member including internally supporting the tubular member on an arbor at a station wherein the arbor has recesses adjacent the regions of the pairs of openings of the rows, shearing the wall of the tubular member at selected spaced regions of the wall by forces directed exteriorly and inwardly of the tubular member and deflecting the sheared portions inwardly into the recesses at said station, transferring the sheared tubular member to another station, mounting the sheared tubular member on a second arbor at said other station, applying at said other station forces interiorly of the tubular member directed outwardly against the portions of the wall adjacent the sheared portions, and bending portions of the wall adjacent the sheared portions outwardly forming the louvered openings defined by the sheared portions and the outwardly bent portions.

10. The method of forming a plurality of louvered openings in the wall of a tubular metal member of circular cross section wherein the louvered openings extend lengthwise of the tubular member and are arranged in pairs in rows disposed lengthwise of the tubular member and spaced circumferentially around the tubular member including engaging a carrier with the tubular member at a loading station, transferring the tubular member by the carrier onto a first arbor at a first processing station wherein the arbor has recesses adjacent the regions of the pairs of openings of the rows, shearing the wall of the tubular member at the regions of the recesses by forces directed exteriorly and inwardly of the tubular member and deflecting the sheared first portions inwardly into the recesses at said first processing station, transferring the sheared tubular member by the carrier onto a second arbor at a second processing station, applying at said second processing station forces interiorly of the tubular member directed outwardly against second portions of the wall adjacent the sheared portions bending the second portions of the wall outwardly forming openings defined by the inwardly deflected first portions and the outwardly bent second portions, and moving the processed tubular member by the carrier to a disposal station.

* * * * *